US006358018B1

(12) United States Patent
Alm

(10) Patent No.: US 6,358,018 B1
(45) Date of Patent: Mar. 19, 2002

(54) HYDRAULIC ROTATING AXIAL PISTON ENGINE

(75) Inventor: Filip Alm, Bohus (SE)

(73) Assignee: Parker Hannifin AB, Boras (SE)

( * ) Notice: Subject to any disclaimer, the term of this patent is extended or adjusted under 35 U.S.C. 154(b) by 0 days.

(21) Appl. No.: 09/633,024

(22) Filed: Aug. 4, 2000

Related U.S. Application Data

(63) Continuation of application No. PCT/SE99/00186, filed on Feb. 12, 1999.

(51) Int. Cl.[7] ..... F04B 1/12; F04B 27/08
(52) U.S. Cl. ..... 417/269; 91/499
(58) Field of Search ..... 417/269, 222.1; 91/499, 486, 506; 92/143

(56) References Cited

U.S. PATENT DOCUMENTS

| | | | | |
|---|---|---|---|---|
| 3,793,924 A | | 2/1974 | Eickmann | |
| 3,834,281 A | * | 9/1974 | Heyl et al. | 91/506 |
| 4,223,594 A | | 9/1980 | Gherner | |
| 4,508,011 A | * | 4/1985 | Nolden | 91/506 |
| 4,920,860 A | | 5/1990 | Alm et al. | |
| 4,934,251 A | * | 6/1990 | Barker | 91/486 |
| 4,934,253 A | | 6/1990 | Berthold et al. | |
| 5,176,066 A | | 1/1993 | Kanamaru et al. | |
| 5,358,388 A | * | 10/1994 | Schutten et al. | 417/269 |
| 5,538,401 A | * | 7/1996 | Schaffner et al. | 417/222.1 |
| 5,568,762 A | * | 10/1996 | Manring | 92/143 |
| 5,593,285 A | * | 1/1997 | Watts | 417/269 |
| 5,636,561 A | * | 6/1997 | Pecorari | 91/499 |
| 6,287,086 B1 | * | 9/2001 | Steen | 417/269 |

FOREIGN PATENT DOCUMENTS

| | | |
|---|---|---|
| CH | 592 812 | 11/1977 |
| EP | 0 567 805 A1 | 4/1993 |
| SE | 431 897 | 5/1984 |

OTHER PUBLICATIONS

Copy of the International Application Published Under the PCT in Case No. PCT/SE98/02218.

Copy of the International Application Published Under the PCT in Case No. PCT/SE99/00186.

Copy of the International Application Published Under the PCT in Case No. PCT/SE99/00187.

* cited by examiner

*Primary Examiner*—Teresa Walberg
*Assistant Examiner*—Leonid M Fastovsky
(74) *Attorney, Agent, or Firm*—Christopher H. Hunter

(57) ABSTRACT

A hydraulic rotating axial piston engine has a housing enclosing a rotatable cylinder barrel. The cylinder barrel has a number of axial cylinders with a number of reciprocating pistons therein. The pistons reciprocate between two defined end positions and cooperate with an angled plate in order to obtain the reciprocating movement. The cylinders have ports alternatingly acting as inlet and outlet ports and the housing has at least one inlet and outlet channel. The channels each have a kidney-shaped port, facing towards the inlet and outlet ports of the cylinder barrel, and communicating with a number of the ports at the barrel. The cylinder barrel is rotatable relative to a first axis, which is inclined relative to a second axis of an input/output shaft. The angled plate is rotatable together with the input/output shaft around the second axis. The rotation of the cylinder barrel and the input/output shaft are synchronized by means of synchronizing means. The combination of the cylinders and pistons are an even number and the synchronizing means has a synchronizing torque which during the whole rotation of the cylinder barrel is directed in substantially one single direction.

7 Claims, 4 Drawing Sheets

HYDRAULIC ROTATING AXIAL PISTON ENGINE

CROSS REFERENCE TO RELATED APPLICATION

This application is a continuation of copending International Application No. PCT/SE99/00186 , filed Feb. 12, 1999 which designated the United States, and claims priority to Swedish Patent Application 9800411-2, filed Feb. 13, 1998.

BACKGROUND OF THE INVENTION

From European Patent Reference EP-A1-O 567 805, a hydraulic piston engine is known, which has a number of axial cylinders. The cylinders are circumferentially arranged in a rotatable cylinder barrel.

Each of the cylinders is provided with a channel, which alternatingly communicates with an inlet port or an outlet port in a housing. It is apparent that the engine is provided with synchronizing means of the type of tooth gear transmission. This type of synchronizing means has backlash which in connection with prior art engines may cause noise, vibrations and power losses. The drawings show a longitudinal cross sectional view showing that the pistons and cylinders in the cylinder barrel are not positioned diametrically opposite to each other. Prior known hydraulic rotating axial piston engines, having synchronizing means with backlash, are namely provided with an uneven number of pistons and cylinders.

From U.S. Pat. No. 4,920,860 a hydraulic piston engine is known having synchronizing means of the type universal joint of tripoid synchronization. From the cross sectional view of the drawing it is apparent that the pistons and cylinders in the cylinder barrel are not arranged in diametrically opposite positions. From the description it is apparent that the number of cylinders is nine, i.e., an uneven number of cylinders. This type of synchronization also has backlash, which in combination with the present type of engine causes noise and vibrations.

It is believed that the common reason behind the above described disadvantages with prior known axial hydraulic piston engines is that the synchronizing torque changes direction.

SUMMARY OF THE INVENTION

The object of the present invention is to provide a hydraulic rotating axial piston engine having reduced noise level and reduced vibrations.

The present object is obtained by means of an engine which is characterized in the combination that the cylinders and pistons are an even number and are positioned pairwise diametrically opposite to each other, and that synchronizing means is provided having a synchronizing torque, which during the entire rotation of the cylinder barrel is directed in substantially one single direction. The ports of the housing and the cylinder barrel ports are arranged to substantially simultaneously discharge and pressurize the pistons in diametrically opposite cylinders.

The present invention relates to a hydraulic rotating axial piston engine. The engine has a housing, enclosing a rotatable cylinder barrel. The barrel has a number of axial cylinders with a number of reciprocating pistons. The pistons reciprocate between two defined end positions, and cooperate by means of piston rods with spherical recesses in an angled plate in order to obtain the reciprocating movement. The pistons are inclined relative to the longitudinal axis of the cylinders, and the cylinders have ports alternatingly acting as inlet and outlet ports. The housing has at least one inlet and outlet channel, each with a kidney shaped port, facing towards the inlet and outlet ports of the cylinder barrel. The kidney shaped ports communicate with a number of the ports at the barrel.

The cylinder barrel is rotatable relative to a first axis, which is inclined relative to a second axis of an input/output shaft. The angled plate is rotatable together with the input/output shaft around the second axis. The cooperation between the piston rods and the recesses in the angled plate create a driving torque in the angled plate. The rotation of the cylinder barrel and the angled plate is synchronized by means of synchronizing means, which includes synchronizing torque transferring surfaces having backlash.

Further features of the present invention will become apparent to those skilled in the art upon reviewing the following specification and attached drawings.

Figure 1:
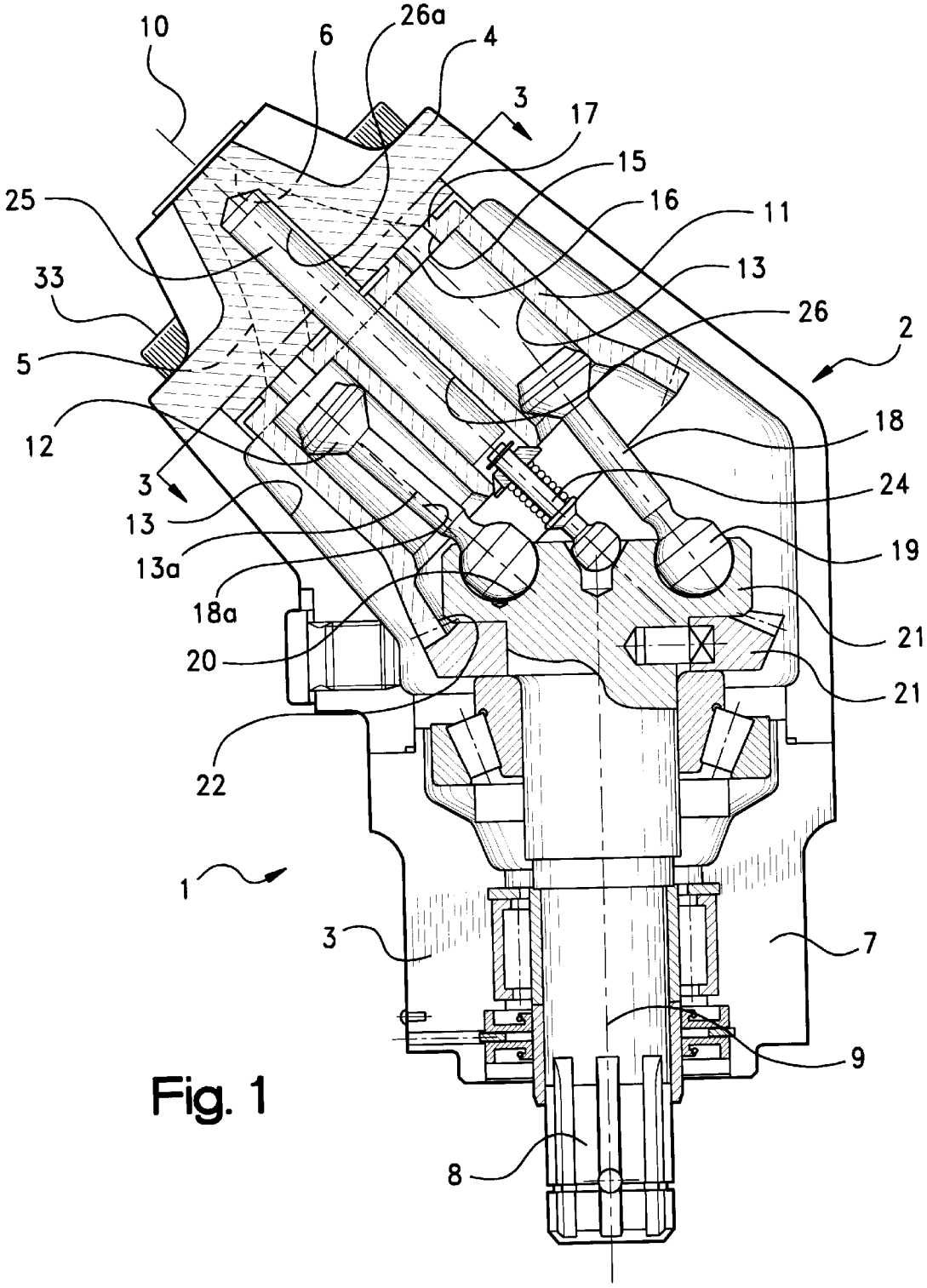
FIG. 1 shows an axial section of a pump according to the present invention.

DETAILED DESCRIPTION OF THE PREFERRED EMBODIMENT:

A hydraulic rotating piston engine according to the present invention is shown in a preferred embodiment in FIG. 1 which shows the general parts of a pump. The pump is an axial piston pump, indicated generally at 1, having a housing, indicated generally at 2. The housing is comprised by at least two parts, and in the shown example three parts, namely a housing part 3 and a connecting part 4. The connecting part 4 has connecting openings, namely an inlet opening 5 and an outlet opening 6 for connecting input and output conduits for hydraulic fluid to the pump. A third part 7 of the housing is a support part of the input shaft 8 which is provided to be connected with a drive motor, not shown. The pump is of a so-called bent axis type, having a first rotational axis 9, forming a rotational axis for the input shaft 8, and a second rotational axis 10 inclined relative to the first axis by an angle of, for example 40°. The second rotational axis 10 is an axis for a cylinder barrel 11 which is rotatably journalled in the housing. The cylinder barrel 11 has a number of axially extending pistons 12, movable axially, i.e. substantially in parallel with the axis 10 in a reciprocating movement in a corresponding number of cylinders 13. Cylinders 13 extend along an axis 13a parallel with the axis 10, and are circumferentially equally spaced along a circle line 14 (see FIG. 3). Each cylinder 13 has a fluid passage 15 with a port 16 in the planar end surface 17 of the cylinder barrel 11. Each port 16 has preferably its largest length along the peripheral circle line 14, and is preferably kidney-shaped.

From FIG. 1 it is further apparent that each piston 12 has a piston rod 18 with a spherical head 19, and is supported in a spherical bearing recess 20 in a swash (or angled) plate 21. The swash plate 21 forms an integral part of the input shaft 8. The spherical recesses 20 are rotatably arranged around a radial plane which is angled relative to the radial plane of the cylinder barrel 11. This results in the reciprocating movement of the pistons 12 and the pumping action according to a prior known principle, in order to create vacuum, i.e., suction, in the inlet opening 5 and pressure in the outlet opening 6 (see for example, U.S. Pat. No. 5,176,066). The cooperation between the pistons 12 and the recesses 20 creates a driving torque in the swash plate 21, which is transferred to the input shaft 8.

Synchronizing means are arranged in order to synchronize the rotational movements of the cylinder barrel with the rotation of the swash plate 21 so that the piston rods 18 will maintain their correct directions. In the shown example, the synchronizing means is made in the form of gear teeth formed by a tooth wheel rim 22 on the cylinder barrel 11 cooperating with a tooth wheel 23 of the input shaft 8.

A support pin 24 supports the cylinder barrel 11 along the axis 10 cooperating with a shaft 25 which forms the rotational axis 10 and projects through a bore 26 of the cylinder barrel, and is supported in a bore 26*a* of the connecting piece 4 of the housing.

As mentioned above, the cylinders 13 extend with their longitudinal axis 13*a* axially, i.e. in parallel with the rotational axis 10 of the cylinder barrel 11. However, it is apparent from FIG. 1 that the longitudinal axis 18*a* of each piston rod 18 will deviate from the longitudinal axis 13*a* of the cylinder in which the piston rod performs a reciprocating movement. The longitudinal axis 18*a* is also the symmetrical axis of each piston which together with its rod will be inclined in each cylinder 13. This inclination depends on the fact that the bearing surfaces 20 are arranged along a circle line in the swash plate 21. As the cylinder barrel 11 and the cylinders 13 are inclined relative to the swash plate 21, the spherical heads 19 perform an elliptic movement as seen along the rotational axis 10. This results in conical movements of the piston rods in the cylinder barrels, which results in turn in a contribution to the total synchronization torque. This contribution is the largest contribution to a bidirectional synchronizing torque, which according to the present invention, is neutralized to a large extent.

Figure 2:
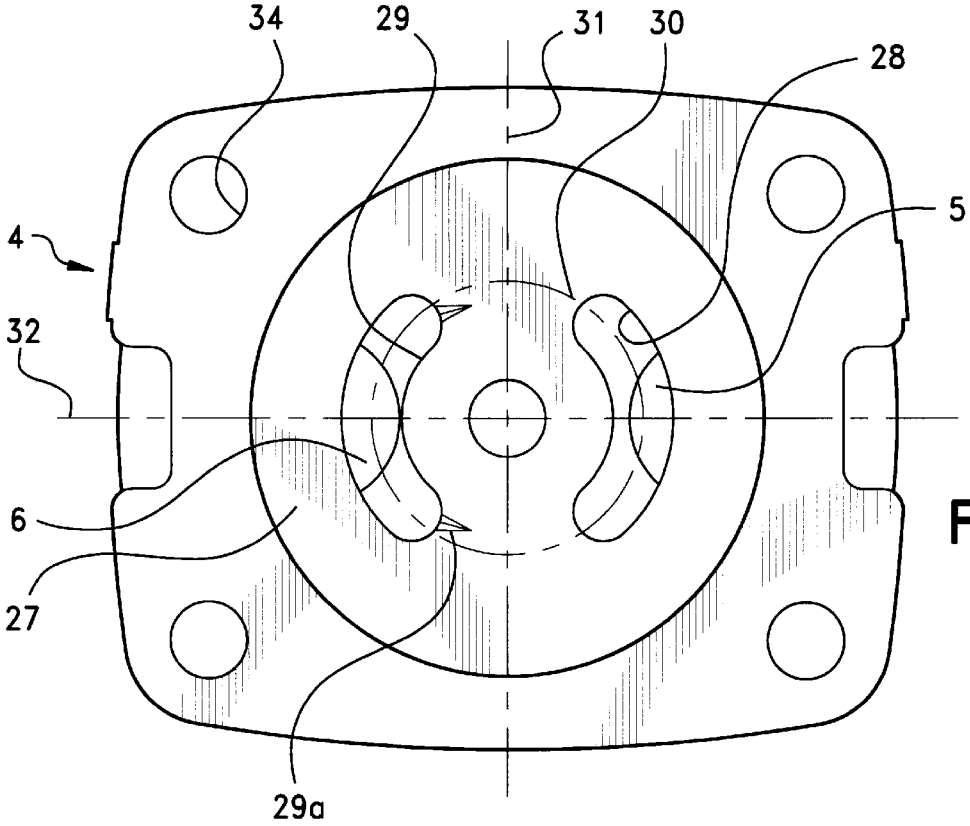
FIG. 2 is a plan view of a connecting part of the pump as seen separately from the inside.

FIG. 2 shows the connecting part 4 of the housing separately and from the inside. The connecting part 4 has on its inside a substantially planar, circular surface 27 which in the mounted position, faces the planar surface 17 of the cylinder barrel 11. The two planar surfaces 17, 27 are arranged to contact each other with a sealing fit. On its inside, the connecting part 4 is provided with one inlet port 28 and one outlet port 29, which are kidney shaped. During rotation, friction arises between the two surfaces. The friction creates a torque, for which the synchronizing torque is supposed to compensate.

The inlet port 28 communicates through a channel with the inlet opening 5, and the inner outlet opening 29 communicates through a separate channel with the outlet opening 6 on the outside of the connecting part 4. The inlet and outlet ports 28, 29 extend along a peripheral circle line 30 which has a corresponding radius as the circle line 14 of the openings 16 of the cylinder barrel 11. The inlet and outlet opening 28, 29 extend on each half of said circle line 30, separated by a main plane 31 extending through the connecting part 4. The inlet and outlet ports 28, 29 are further divided by a second main plane 32 extending 90° relative to the first main plane 31. One of these main planes can be a symmetrical plane for the connecting part 4.

The inlet and outlet ports 28, 29 further extend along the circle line 30 along a predetermined peripheral angle, which in the shown example is somewhat larger for the inlet opening 5 than for the outlet opening 6, and the ports are arranged so that simultaneously more than one cylinder port 16 communicates with the inlet port 28 and the outlet port 29, respectively. One or both of the inlet and outlet ports 28, 29 can be provided with slit extensions 29*a*, the ends of which determine the total angular extension of the inlet and outlet ports. According to the preferred embodiment, the inlet and the outlet ports 28, 29 have the same angular extension. Preferably, the inlet and outlet ports 28, 29 are symmetrically positioned relative to each other, however, the angular extension can differ between the ports, and the ports may also be positioned without symmetry.

The connecting part 4 is provided with connecting means for connecting the connecting part in a chosen position with the housing part 3. This is accomplished by means of screws 33 (see FIG. 1), extending through holes 34 in the connecting part (see FIG. 2), and screwed into threaded holes 35 in the housing part 3 (see FIG. 3). By means of this connection, the angular position of the connecting part with respect to its main planes 31, 32 is determined relative to the main planes 37, 38 of the housing part.

Figure 3:
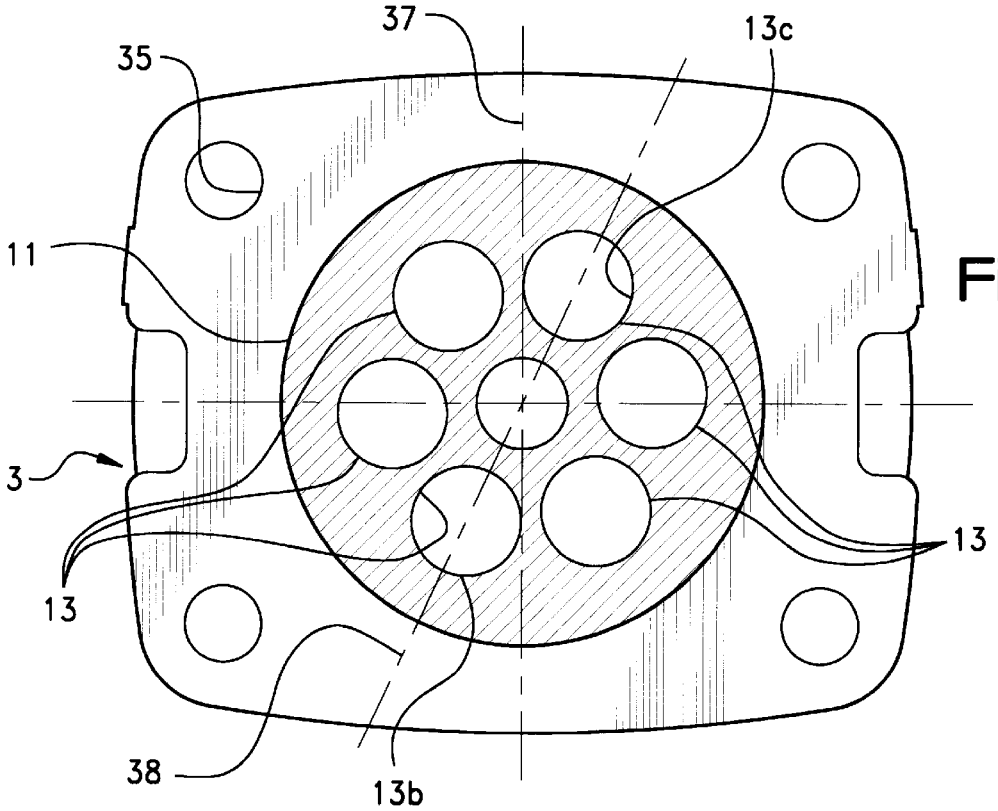
FIG. 3 is a cross sectional view of the pump along the lines Ill-Ill in FIG. 1.

From the sections according to FIG. 3, the arrangement of the cylinders 13 in the cylinder barrel 11 is shown. The cylinders are according to the present invention an even number, for example six cylinders, which are pairwise diametrically positioned opposite to each other, and arranged symmetrically relative to a diameter 38 extending through the cylinder barrel.

Figure 4:
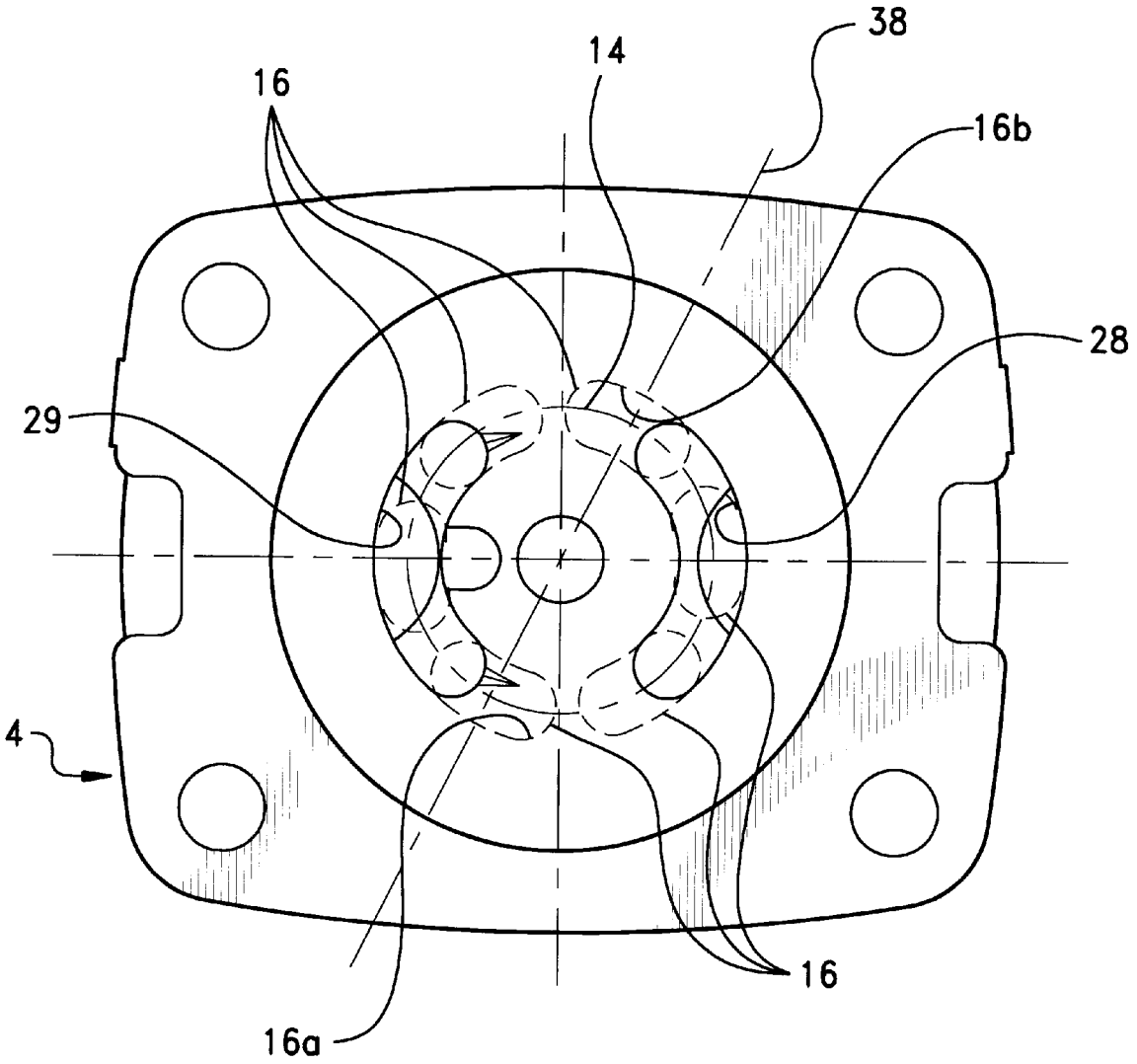
FIG. 4 corresponds to FIG. 2, having cylinder barrel ports indicated with dotted and dashed lines.

In FIG. 4, the connecting part 4 according to FIG. 2 is shown with the arrangement of the ports 16 in the end surface 17 of the cylinder barrel 11 indicated by means of dotted and dashed lines. The ports 16 are circumferentially equally spaced along a circle line which may be the same circle line 14 as for the cylinders 13. The cylinder ports 16 are pairwise diametrically arranged opposite to each other, i.e., symmetrically arranged relative to a diameter, for example the diameter line 38. The number of cylinder ports 16 is an even number, in the shown example, six ports (i.e., one port associated with each of the six cylinders shown in FIG. 3) .

By means of the above arrangement and based upon a chosen angular extension of the kidney shaped inlet and outlet ports 28, 29 in the connecting part 4, upon rotation of the input shaft 8 and the swash plate 21 by means of the motor, the pistons are given their reciprocal movements in combination with the rotation of the cylinder barrel. By means of the pistons the hydraulic fluid will be sucked into the inlet port 28, which represents the low pressure side; and forced out through the outlet port 29, which represents the high pressure side. This continuous rotation of the barrel and the reciprocal movements of the pistons creates the pumping action.

The pistons move between their lower dead point (LDP) and upper dead point (UPD) which occurs for each piston in a predetermined angular position relative to the angular positions of the inlet and outlet ports 28, 29. The angular positions are chosen so that the ports of the housing, i.e., of the connecting part 4, and the cylinder barrel ports 16*a*, 16*b* are arranged to substantially simultaneously discharge and pressurize the hydraulic fluid acting on pistons 12 in diametrically opposite cylinders (e.g., cylinders 13*b*, 13*c* in FIG. 3). This results in the fact that the synchronizing torque, i.e., the torque transferred to the cylinder barrel by means of the synchronizing means, will during the entire rotation of the cylinder barrel be directed in substantially one single direction. This characteristic is especially advantageous due to the fact that the synchronizing means as shown has backlash. Other examples of synchronizing means having backlash is universal joint of tripoid synchronization, and conical pistons synchronizing means which can be utilized as alternatives to the shown tooth gear transmission. In an engine having conical piston synchronizing means, the piston or their rods have conical surfaces contacting the cylindrical surfaces of the cylinders. During the rotation of the engine, the conical surface will maintain a linear roll contact. Different pistons will maintain contact in different directions in their respective cylinders, which is utilized to synchronize the cylinder barrel with the swash plate. An example of this type of synchronization is described in Swiss Patent Reference CH 592812.

Figure 5:
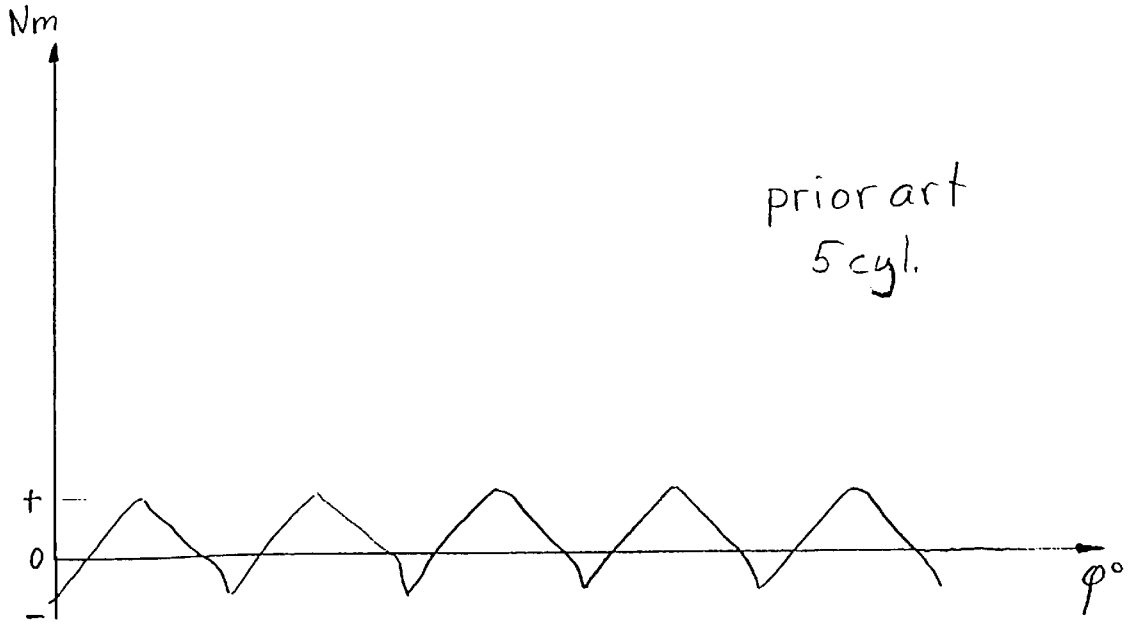
FIG. 5 shows a diagram over the synchronizing torque in an engine according to prior art.

FIG. 5 shows a diagram of the synchronizing torque of the synchronizing means of the type discussed above but utilized in a prior known engine having an uneven number of cylinders, namely five cylinders. From the diagram it is apparent that the torque is bidirectional, causing noise, vibrations and power losses. As mentioned above, one large contribution to bidirectional torque is the torque caused by the fact that the piston rods are inclined in their cylinders.

Figure 6:
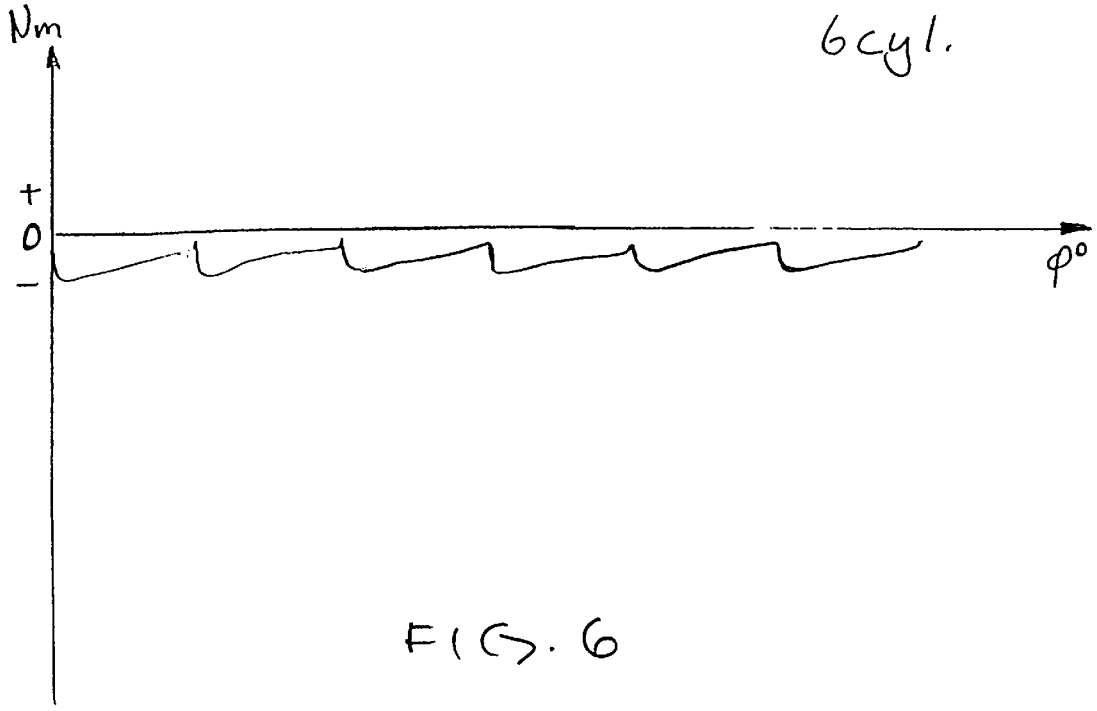
FIG. 6 shows a diagram over the synchronizing torque in the engine according to the present invention.

FIG. 6 shows a diagram of the synchronizing torque in the engine according to the present invention having an even number of cylinders, for example six cylinders. From this diagram it is apparent that the torque is unidirectional, being directed in substantially one single direction. The lowered noise level and vibration level and reduction of power losses is surprisingly large in the engine according to the present invention.

The invention is not restricted to the above described and in the drawings shown embodiments. For example a different number of cylinders and synchronization can be utilized. For example eight or ten cylinders can be utilized. The same principle can also be utilized for a hydraulic motor in which the inlet port of the housing is connected to a pressurized hydraulic source and the shaft 8 is an output shaft transmitting power torque to a machine to be driven by the hydraulic motor.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A hydraulic rotating axial piston engine comprising:

a housing enclosing a rotatable cylinder barrel, said rotatable cylinder barrel having an even number of axial cylinders with an even number of reciprocating pistons therein, said pistons reciprocating between two defined end positions, and cooperating by means of piston rods with spherical recesses in an angled plate in order to obtain the reciprocating movement, said pistons being inclined relative to the longitudinal axis of the cylinders, said cylinders having ports alternatingly acting as inlet and outlet ports, said housing having at least one inlet and outlet channel, each with a kidney shaped port, facing towards said inlet and outlet ports of said cylinder barrel and communicating with a number of said ports at said barrel, said cylinder barrel being rotatable relative to a first axis, which is inclined relative to a second axis of an input/output shaft, said angled plate being rotatable together with said input/output shaft around said second axis, said cooperation between said piston rods and said recesses in the angled plate creating a driving torque in the angled plate, the rotation of said cylinder barrel and said angled plate being synchronized by means of synchronizing means, said synchronizing means including synchronizing torque transferring surfaces having backlash, said cylinders and pistons positioned pairwise diametrically opposite to each other, and said synchronizing means having a synchronizing torque which during the entire rotation of the cylinder barrel is directed in substantially one single direction, and the ports of said housing and said cylinder barrel ports are arranged to substantially simultaneously discharge and pressurize the pistons in diametrically opposite cylinders .

2. The hydraulic rotating axial piston engine according to claim 1, wherein in said kidney shaped ports of the inlet and outlet channels have substantially the same angular extension and are substantially symmetrically positioned relative to each other.

3. The hydraulic rotating axial piston engine according to claim 1, wherein said syncronizing means is a tooth gear transmission.

4. The hydraulic rotating axial piston engine according to claim 1, wherein said syncronizing means is a universal joint of tripoid synchronization.

5. The hydraulic rotating axial piston engine according to claim 1, wherein said syncronizing means is a conical piston synchronizing means, including contact between conical surfaces of the piston rods of the pistons and surfaces of the cylinders.

6. The hydraulic rotating axial piston engine according to claim 1, wherein said engine is a pump and said shaft is an input shaft to be driven by a rotating motor.

7. The hydraulic rotating axial piston engine according to claim 3, wherein said engine is a pump and said shaft is an input shaft to be driven by a rotating motor.

* * * * *